US009302825B2

(12) United States Patent
Liu

(10) Patent No.: US 9,302,825 B2
(45) Date of Patent: Apr. 5, 2016

(54) ELECTRONIC CIGARETTE CASE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 180 days.

(21) Appl. No.: 14/057,123

(22) Filed: Oct. 18, 2013

(65) Prior Publication Data

US 2015/0041482 A1 Feb. 12, 2015

(51) Int. Cl.

| | |
|---|---|
| ***B65D 43/14*** | (2006.01) |
| ***B65D 51/04*** | (2006.01) |
| ***B65D 43/16*** | (2006.01) |
| ***B65D 25/10*** | (2006.01) |
| ***B65D 43/22*** | (2006.01) |
| ***B65D 43/24*** | (2006.01) |
| ***B65D 85/20*** | (2006.01) |

(52) U.S. Cl.

CPC ..... *B65D 43/163* (2013.01); *B65D 25/108* (2013.01); *B65D 43/22* (2013.01); *B65D 43/24* (2013.01); *B65D 85/20* (2013.01)

(58) Field of Classification Search

CPC ..... B65D 43/16; B65D 43/163; B65D 43/24; B65D 43/14; A24F 15/00

USPC ..... 220/847, 829, 827, 810, 326, 315; 206/266, 265, 242

See application file for complete search history.

(56) References Cited

U.S. PATENT DOCUMENTS

| | | | | | |
|---|---|---|---|---|---|
| 374,584 | A * | 12/1887 | Cook | E05F 1/1066 | 126/291 |
| 501,689 | A * | 7/1893 | Oldenbusch | B65D 45/16 | 220/326 |
| 540,440 | A * | 6/1895 | Heissenberger | A24F 27/00 | 206/121 |
| 744,074 | A * | 11/1903 | Hiering | B65D 50/045 | 206/1.5 |
| 799,844 | A * | 9/1905 | Fuller | A24F 27/10 | 206/134 |
| 969,329 | A * | 9/1910 | Blake | B65D 1/04 | 206/38 |
| 1,445,869 | A * | 2/1923 | Chalfant | B65D 45/24 | 220/323 |
| 1,455,133 | A * | 5/1923 | Downs | B65D 45/06 | 16/286 |
| 1,503,187 | A * | 7/1924 | Fitchett | F01P 11/0214 | 220/326 |

(Continued)

*Primary Examiner* — Nathan J Newhouse
*Assistant Examiner* — Jennifer N Zettl
(74) *Attorney, Agent, or Firm* — Tim Tingkang Xia, Esq.; Locke Lord LLP

(57) ABSTRACT

The present application provides an electronic cigarette case; and the electronic cigarette case comprises a case body, a case cover hinged with the case body via a hinging portion, and an elastic member is fixed in the case body; the elastic member includes a first flange protruding towards the case cover, and a first extension arm slantly extending from a side of the first flange and extending along a direction away from the case cover; a protruding portion is formed on the case cover, and the protruding portion slidably abuts against surfaces of the first extension arm and the first flange facing the case cover. The structure of the electronic cigarette case is simple, and the case cover can be opened or closed by a small external force. Thus, the opening and closing operations are easy, and the user's experience is improved.

15 Claims, 16 Drawing Sheets

(56) References Cited

U.S. PATENT DOCUMENTS 1,611,494 A * 12/1926 Strauss ..... A45C 13/345 206/1.5
1,700,539 A * 1/1929 Ladd ..... A24F 15/12 206/252
1,724,735 A * 8/1929 Selbach ..... A24C 5/42 131/73
1,743,279 A * 1/1930 Lindstedt ..... A16N 21/06 184/91
1,755,063 A * 4/1930 Holden ..... A45C 13/345 217/60 B
1,778,729 A * 10/1930 Remington ..... A24F 15/12 206/266
1,830,583 A * 11/1931 Ritz Woller ..... A24F 15/12 206/259
1,902,978 A * 3/1933 Von Frankenberg .... A24F 15/18 206/250
1,903,450 A * 4/1933 Goodman ..... A24F 15/04 206/265
1,991,719 A * 2/1935 Aronson ..... A24F 15/12 206/1.5
1,994,218 A * 3/1935 Hiering ..... A24F 15/12 206/259
2,126,049 A * 8/1938 Shiffman ..... A47F 7/03 217/57
2,155,613 A * 4/1939 Negbaur ..... A24F 15/12 206/1.5
2,157,255 A * 5/1939 Bumpass ..... B65D 15/02 131/242
2,175,673 A * 10/1939 Shields ..... B65D 43/26 220/326
2,288,255 A * 6/1942 Ross ..... A45C 11/04 206/6
2,296,772 A * 9/1942 Crist ..... A24C 5/42 131/73
2,303,147 A * 11/1942 Tinnerman ..... E05F 1/1284 16/277
2,303,859 A * 12/1942 Panzer ..... A24F 15/04 206/250
2,327,120 A * 8/1943 McCoon ..... A24F 15/14 206/250
2,333,270 A * 11/1943 Opler ..... A24F 15/12 206/205
2,338,425 A * 1/1944 Goldbert ..... A24F 15/16 206/256
2,411,946 A * 12/1946 Vogel ..... A24F 15/12 206/1.5
2,418,526 A * 4/1947 Reitman ..... B65D 75/68 206/264
2,461,330 A * 2/1949 Landwehr ..... F23Q 2/08 220/315
2,702,116 A * 2/1955 Shnitzler ..... A45D 27/22 206/228
2,897,958 A * 8/1959 Tarleton ..... A24F 15/12 206/250
3,033,419 A * 5/1962 Lebach ..... B65D 63/02 206/252
3,119,517 A * 1/1964 Adams ..... B65D 5/724 206/252
3,888,386 A * 6/1975 Svensson ..... A45C 13/34 220/829
3,930,594 A * 1/1976 Jungmann ..... E05F 1/1223 16/321
4,101,023 A * 7/1978 Schuander ..... B65D 43/16 206/566
4,113,091 A * 9/1978 Ackeret ..... G11B 23/0233 206/387.1
4,114,236 A * 9/1978 Vandervort ..... E05D 11/105 16/335
4,460,105 A * 7/1984 Cox ..... E05C 17/38 217/60 C
4,621,649 A * 11/1986 Osterrath ..... A24F 15/18 131/185
4,850,481 A * 7/1989 Chern ..... A24F 15/18 206/242
4,863,053 A * 9/1989 Oberg ..... B65D 45/22 220/326
5,082,132 A * 1/1992 Tsai ..... B65F 1/0066 220/23.83
5,123,530 A * 6/1992 Lee ..... A24F 15/14 206/249
5,205,402 A * 4/1993 Maeda ..... A24F 15/14 206/250
5,215,726 A * 6/1993 Kudla ..... A61B 19/0271 206/370
5,356,025 A * 10/1994 Renault ..... A45D 40/0068 132/293
5,465,738 A * 11/1995 Rowland ..... A24F 23/04 131/180
5,651,063 A * 7/1997 Ji ..... H04M 1/0216 16/335
5,884,797 A * 3/1999 Asbach ..... A45C 5/14 220/379
5,967,310 A * 10/1999 Hill ..... A24F 23/04 131/329
5,967,312 A * 10/1999 Jacobs ..... A24F 23/04 131/329
6,693,850 B2 * 2/2004 Mulaw ..... G04B 47/006 206/242
6,860,387 B2 * 3/2005 Chang ..... B65D 43/24 16/295
7,350,664 B2 * 4/2008 Nam ..... E05D 7/086 220/262
8,307,834 B1 * 11/2012 Palmerino, Sr. ..... A24F 15/005 131/270
D683,898 S * 6/2013 Liu ..... D13/108
D688,418 S * 8/2013 Liu ..... D13/108
D723,734 S * 3/2015 Liu ..... D27/189
D723,735 S * 3/2015 Liu ..... D27/189
D723,736 S * 3/2015 Liu ..... D27/189
D723,737 S * 3/2015 Liu ..... D27/189
D723,738 S * 3/2015 Liu ..... D27/189
D735,936 S * 8/2015 Liu ..... D27/189
D735,937 S * 8/2015 Liu ..... D27/186
2011/0073596 A1 * 3/2011 Chang ..... B65D 77/0453 220/23.87
2011/0174644 A1 * 7/2011 Chan ..... B65D 43/16 206/305
2013/0248385 A1 * 9/2013 Scatterday ..... A24F 15/12 206/86
2013/0336358 A1 * 12/2013 Liu ..... G01K 13/002 374/152
2013/0340778 A1 * 12/2013 Liu ..... A24F 47/008 131/329
2013/0341218 A1 * 12/2013 Liu ..... A24F 15/18 206/242
2013/0342157 A1 * 12/2013 Liu ..... A24F 15/18 320/107
2014/0007892 A1 * 1/2014 Liu ..... G08C 23/02 131/329
2014/0020697 A1 * 1/2014 Liu ..... A24F 15/00 131/329
2014/0053858 A1 * 2/2014 Liu ..... A24F 15/18 131/329
2014/0060524 A1 * 3/2014 Liu ..... A24F 47/008 128/200.14
2014/0060527 A1 * 3/2014 Liu ..... A61M 15/06 128/202.21
2014/0216961 A1 * 8/2014 Liu ..... A24F 15/12 206/266
2014/0286002 A1 * 9/2014 Liu ..... F21V 33/0004 362/154
2014/0299491 A1 * 10/2014 Liu ..... A24F 15/18 206/236
2014/0299492 A1 * 10/2014 Liu ..... A24F 15/12 206/264
2014/0353185 A1 * 12/2014 Liu ..... A24F 15/12 206/249
2014/0374289 A1 * 12/2014 Liu ..... A24F 15/12 206/268
2015/0034507 A1 * 2/2015 Liu ..... B65D 85/10 206/256

* cited by examiner

ELECTRONIC CIGARETTE CASE

CROSS-REFERENCE TO RELATED APPLICATION

This application claims priority of application No. 201320484343.X, filed on Aug. 8, 2013 in the Intellectual Property Office of The Republic of China, which is incorporated by reference herein in its entirety.

FIELD OF THE INVENTION

The present application relates to the field of electrical cigarette, and more particularly relates to an electronic cigarette case.

BACKGROUND OF THE INVENTION

Case covers of typical electronic cigarette cases are all opened by two methods. The first method is manual opening, namely, opening a case cover by a human hand without any bouncing mechanism. The second method is adopting an automatically opening torsion spring mechanism, namely, mounting a torsion spring on a rotation axle of a case cover and opening the case cover via torsion force of a torsion spring. In these two methods, a defect of the first method is that the case cover cannot be automatically opened or closed using a bouncing mechanism and the operation is difficult. Although the second method adopting the automatically opening torsion spring mechanism that can supply the power for opening the case cover, a press button or a push button needs to be added. This structure is complicated and does not have a simple appearance. Furthermore, the exposed torsion spring may adversely affect the appearance.

SUMMARY OF THE INVENTION

The objective of the present application is to provide an electronic cigarette case with a case cover that can be semi-automatically opened and closed, aiming at the defect that the electronic cigarette cases in the prior art have complicated structures and are difficult to use.

The technical solutions of the present application for solving the technical problems are as follows:

In one aspect, an electronic cigarette case is provided, and the electronic cigarette case comprises a case body, a case cover hinged with the case body via a hinging portion, and an elastic member is fixed in the case body;

the elastic member includes a first flange protruding towards the case cover, and a first extension arm slantly extending from a side of the first flange and extending along a direction away from the case cover;

a protruding portion is formed on the case cover, and the protruding portion slidably abuts against surfaces of the first extension arm and the first flange facing the case cover;

when the case cover is rotated along an open direction relative to the case body, the protruding portion resists the first extension arm and slides to the first flange along the first extension arm, and the first flange drives the protruding portion to continuously rotate along the rotating direction of the case cover until the case cover is fully open.

In one embodiment, a side of the case cover where the hinging portion is mounted extends along a direction away from a top of the case cover to form the protruding portion.

In another embodiment, the elastic member further includes a second extension arm; the first extension arm and the second extension arm are respectively located at two opposite sides of the first flange, and slantly extend along two opposite directions respectively.

In another embodiment, the first extension arm and the second extension arm are straight or arc-shaped; and the first extension arm, the second extension arm, and the first flange cooperatively form an inverted-V structure or an arc-shaped structure.

In another embodiment, a bending portion is connected to an end of the first extension arm that is away from the second extension arm, and the bending portion bends away from the case cover and cooperates with the first extension arm to form a second flange.

In another embodiment, a portion of an inner surface of the case body corresponding to the second flange forms a guiding surface, the guiding surface is configured to abut against the second flange and lead the second flange to slide along the guiding surface when the case cover is opened or closed, and the guiding surface is a slant surface or a curved surface.

In another embodiment, the elastic member further includes a third extension arm, and two ends of the third extension arm are respectively fixedly connected to the second extension arm and the case body.

In another embodiment, the case body accommodates a bracket, and the third extension arm is connected to the case body via the bracket.

In another embodiment, the third extension arm defines a first through-hole configured to enable a screw to pass through, the bracket defines a threaded hole; the screw passes through the first through-hole, and is screwed in the threaded hole so that the third extension arm is fixed on the bracket.

In another embodiment, the bracket defines at least one accommodating portion configured to accommodate an electronic cigarette; a fixing ring is embedded in the accommodating portion; and the electronic cigarette is inserted in the fixing ring by interference fit.

In another embodiment, the fixing ring is made of soft material.

In another embodiment, the third extension arm is a line-folded structure or a line-curved structure extending along a direction away from the first extension arm.

In another embodiment, the third extension arm extends horizontally, and cooperates with the first extension arm and the second extension arm to form an elongated line-folded structure or an elongated line-curved structure.

In another embodiment, a first connecting portion disposed horizontally is connected to an end of the third extension arm, and the first through-hole is defined in the first connecting portion; a first lug boss is formed on the bracket, and a surface of the first lug boss corresponds to the first connecting portion; and the threaded hole is defined in the first lug boss;

the first connecting portion is arranged on the first lug boss; and the screw passes through the first through-hole and is screwed in the threaded hole.

In another embodiment, the third extension arm extends vertically, and cooperates with the second extension arm to form an elongated line-folded structure or an elongated line-curved structure.

In another embodiment, a second connecting portion disposed vertically is connected to an end of the third extension arm, and the first through-hole is arranged in the second connecting portion; a second lug boss is formed on the bracket, and a surface of the second lug boss corresponds to the second connecting portion; and the threaded hole is defined in the second lug boss;

the second connecting portion is arranged on the second lug boss; and the screw passes through the first through-hole and is screwed in the threaded hole.

In another embodiment, the third extension arm further includes an arm body connected to the second connecting portion; the bracket further includes a baffling portion disposed between the arm body and the second lug boss; the second connecting portion passes through the baffling portion; and an end of the arm body that is adjacent to the second connecting portion abuts against the baffling portion.

In another embodiment, the elastic member is a metal elastic plate, a metal wire, or a plastic elastic plate.

When implementing the electronic cigarette case of the present application, the following advantageous effects can be achieved:

by fixing the elastic member including the first flange and the first extension arm inside the case body of the electronic cigarette case, and forming the protruding portion that slidably abuts against surfaces of the first flange and the first extension arm facing the case cover on the case cover, the following operations can be achieved: when the case cover is opened, the protruding portion slides to the first flange, and the first flange drives the protruding portion to open the case cover until the case cover is fully opened; and when the case cover is closed, the protruding portion also slides to the first flange, and the first flange drives the protruding portion to close the case cover until the case cover is fully closed. The structure of the electronic cigarette case is simple, and the case cover can be opened or closed by a small external force. Thus, the opening and closing operations are easy, and the user's experience is improved.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

Figure 1:
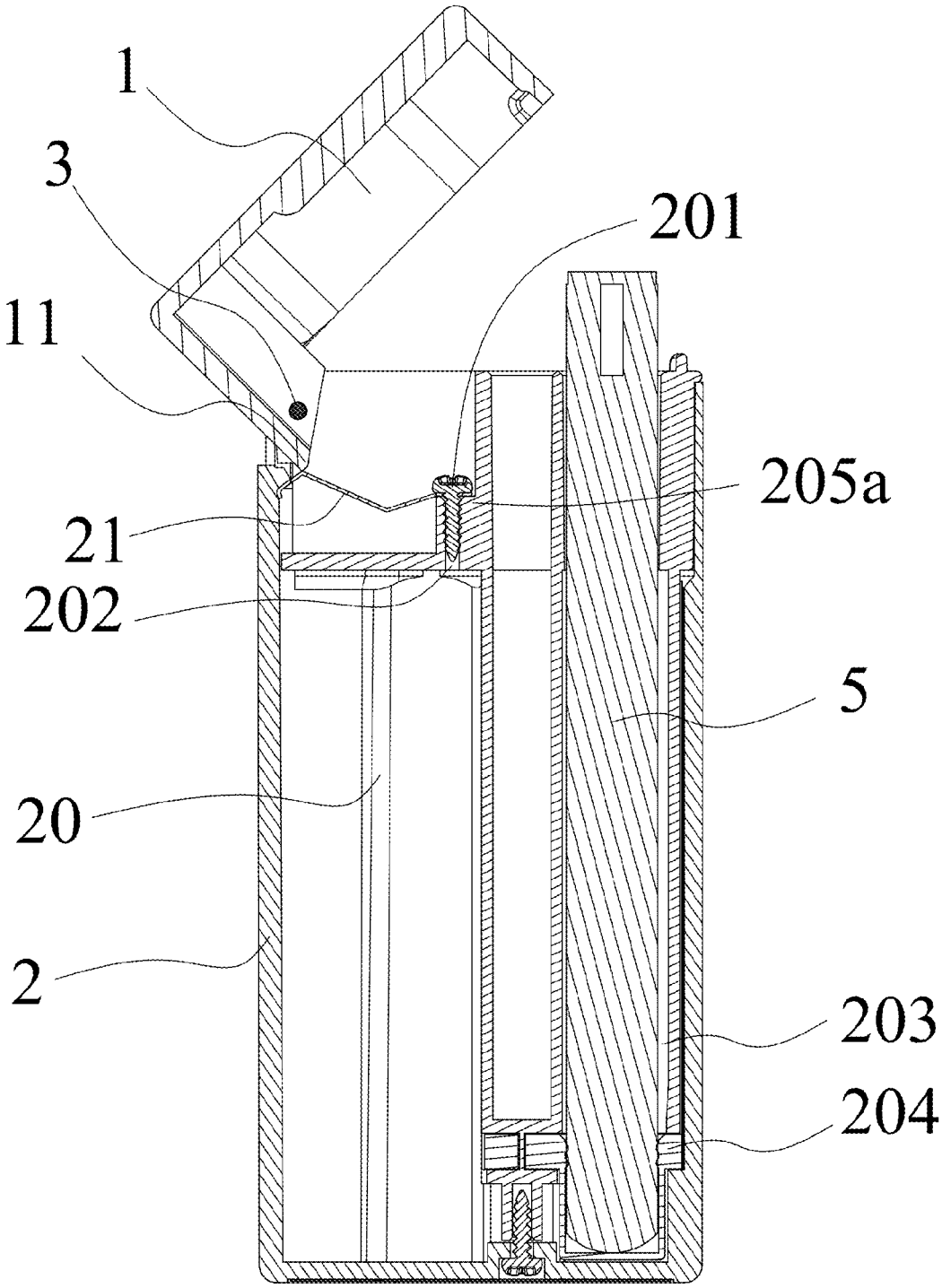
FIG. 1 is an overall structural cut-away view of an electronic cigarette case of a first embodiment of the present application.
Figure 2:
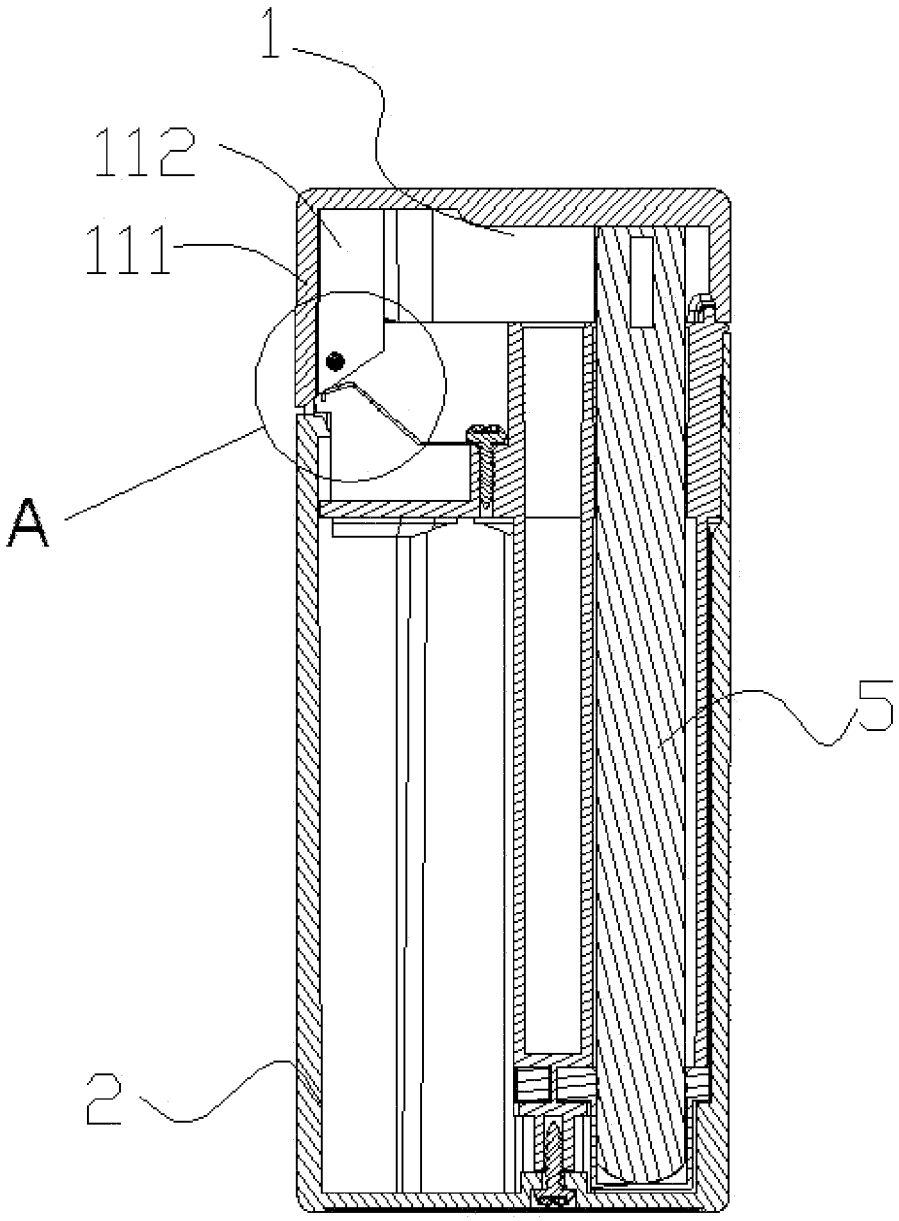
FIG. 2 is a cut-away view of the electronic cigarette case shown in FIG. 1, wherein the case cover is fully closed.
Figure 3:
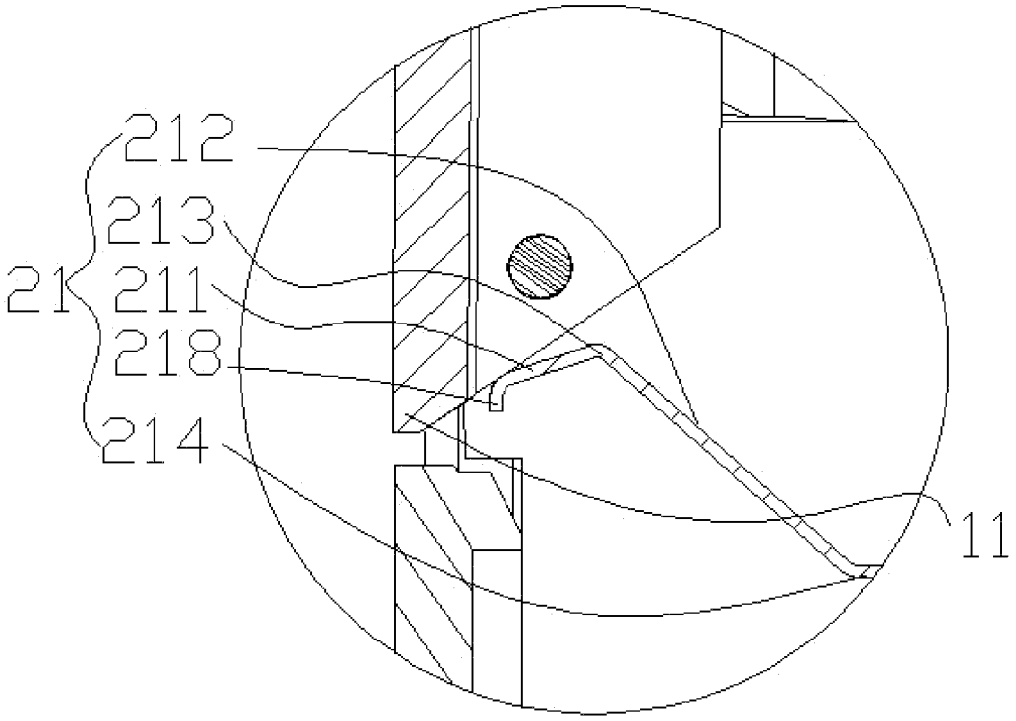
FIG. 3 is an enlarged view of the portion A shown in FIG. 2.
Figure 4:
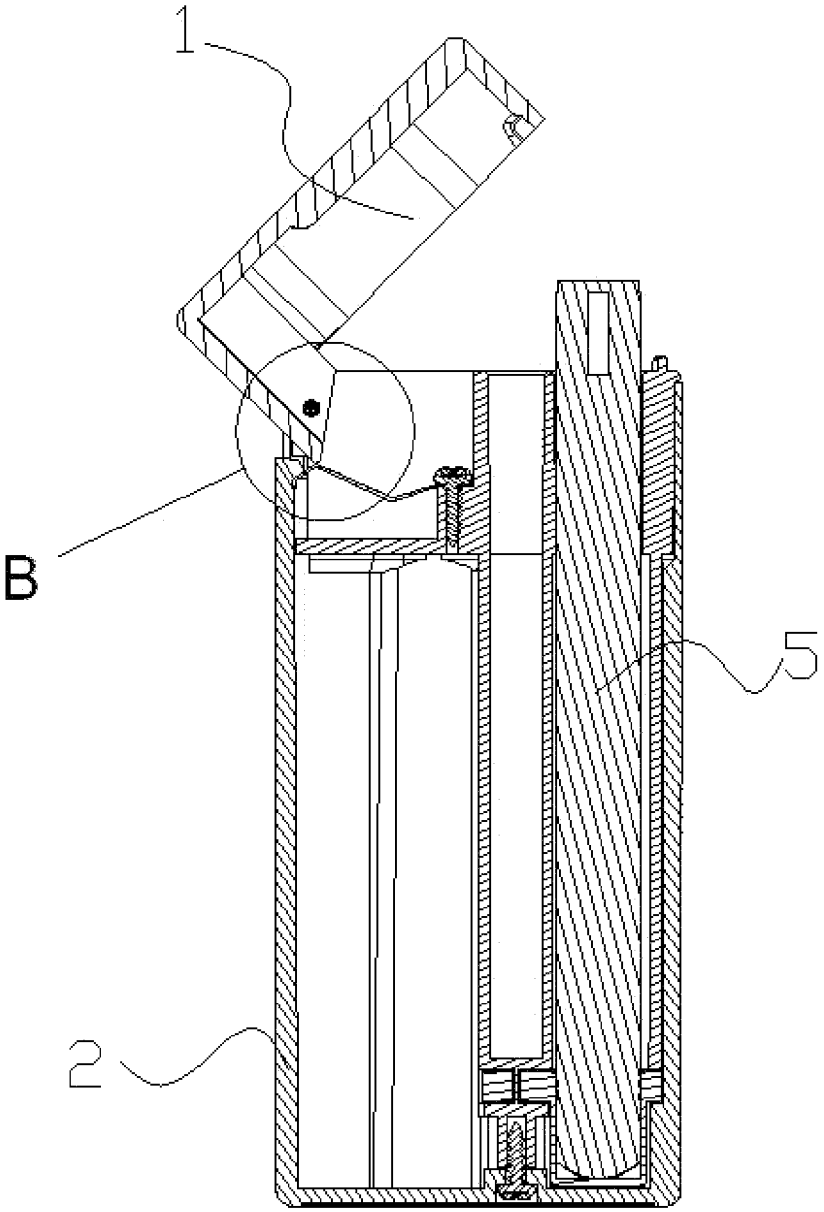
FIG. 4 is a cut-away view of the electronic cigarette case shown in FIG. 1, wherein the case cover is semi-open.
Figure 5:
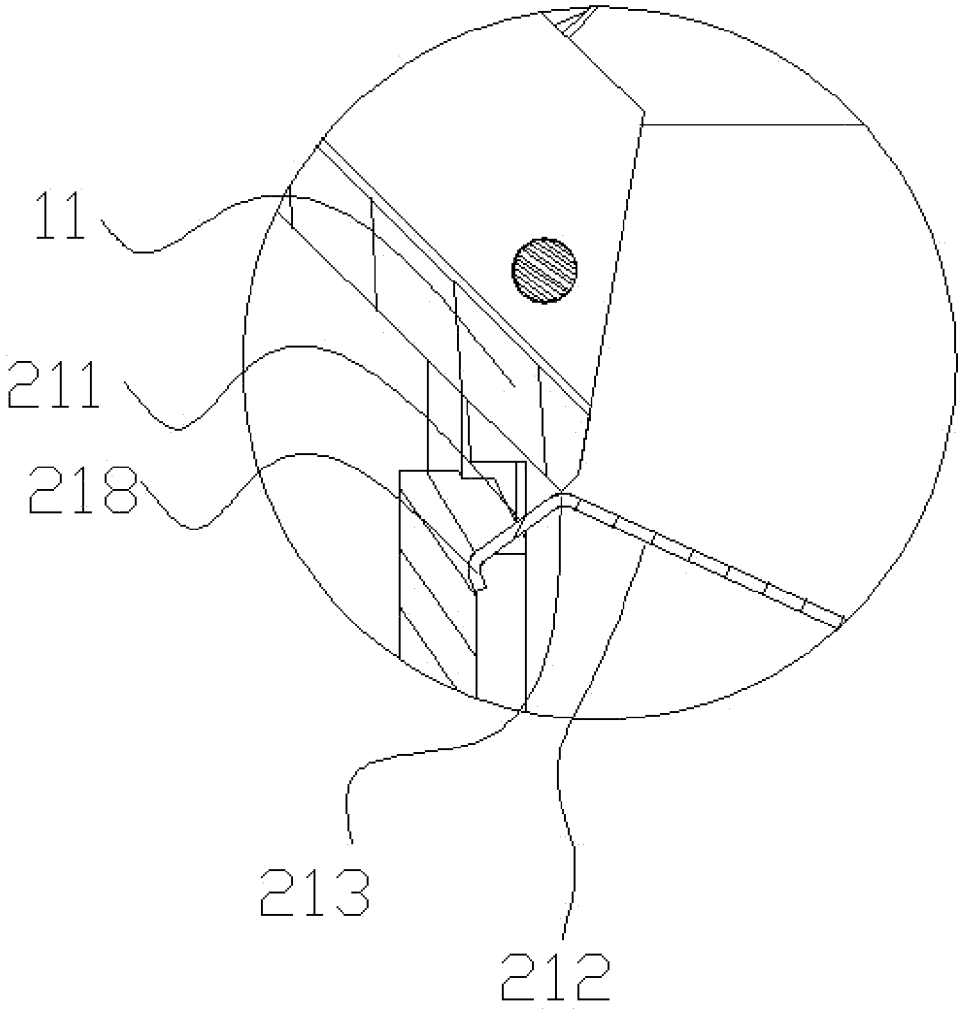
FIG. 5 is an enlarged view of the portion B shown in FIG. 4.
Figure 6:
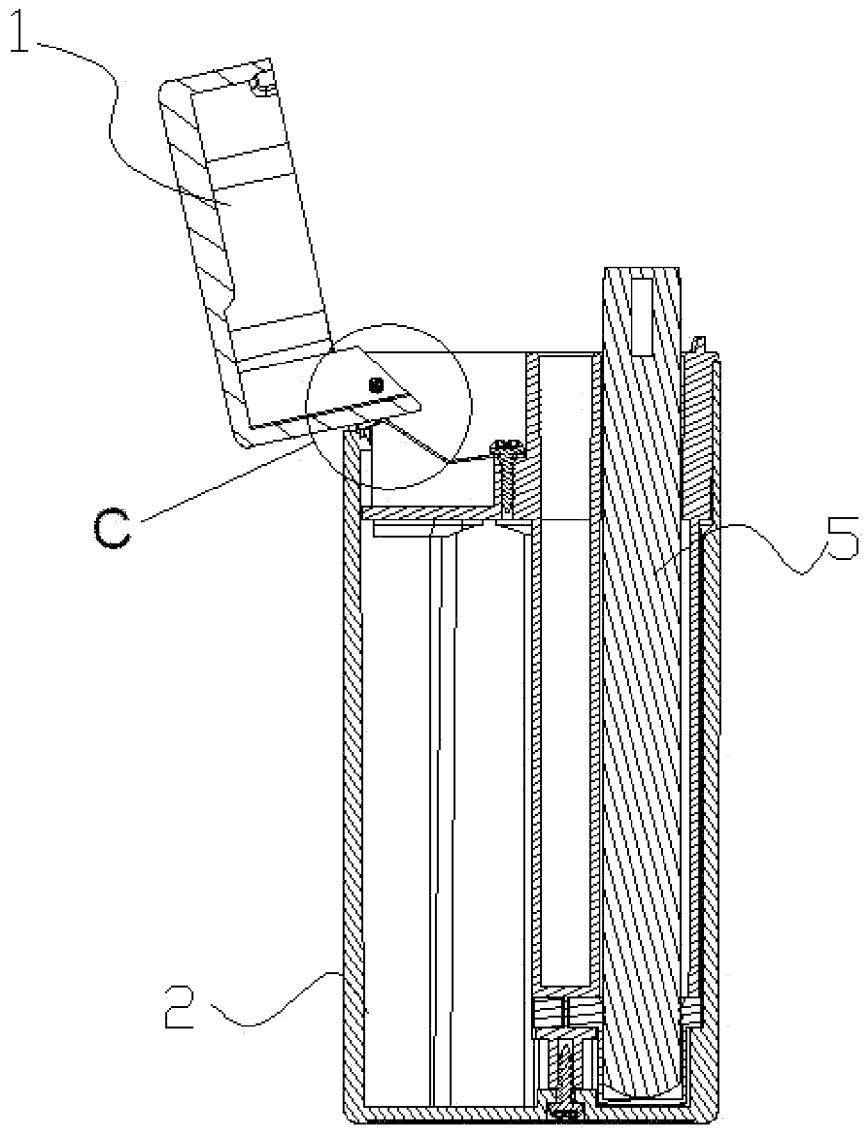
FIG. 6 is a cut-away view of the electronic cigarette case shown in FIG. 1, wherein the case cover is fully open.
Figure 7:
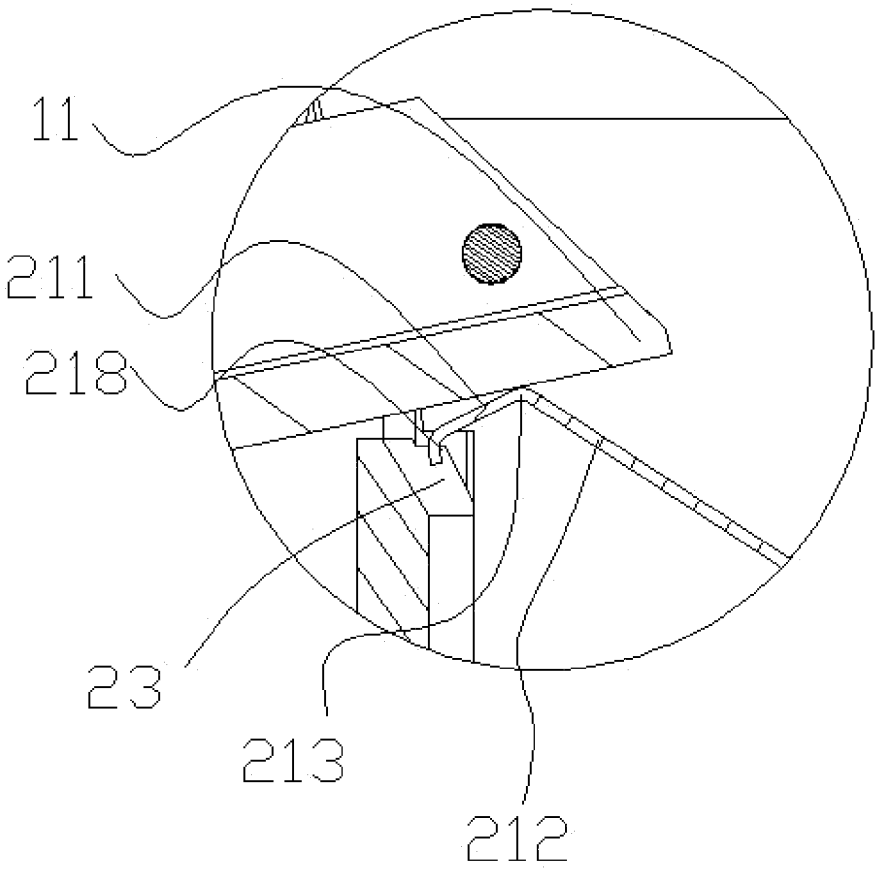
FIG. 7 is an enlarged view of the portion C shown in FIG. 6.
Figure 8:
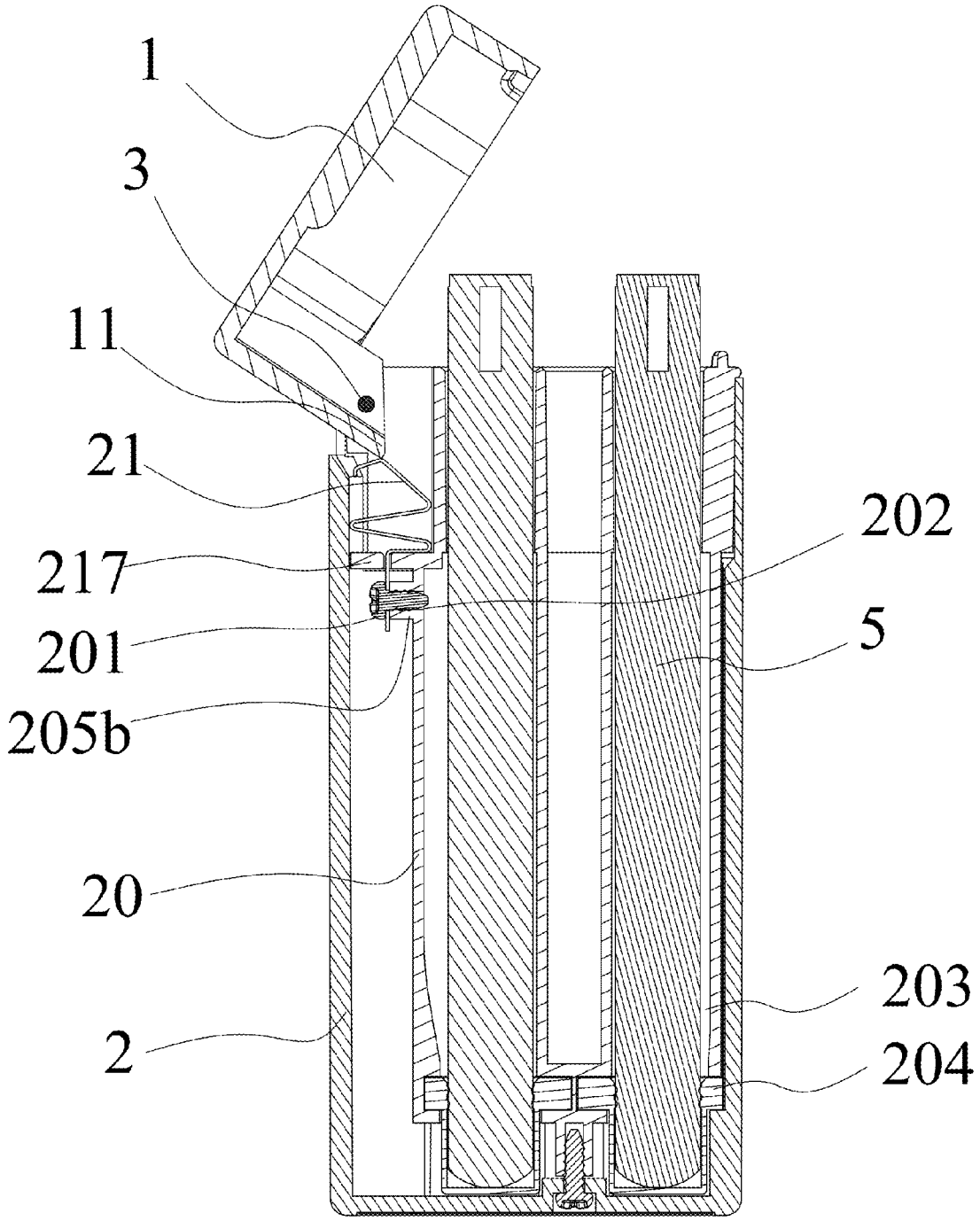
FIG. 8 is an overall structural cut-away view of an electronic cigarette case of a second embodiment of the present application.
Figure 9:
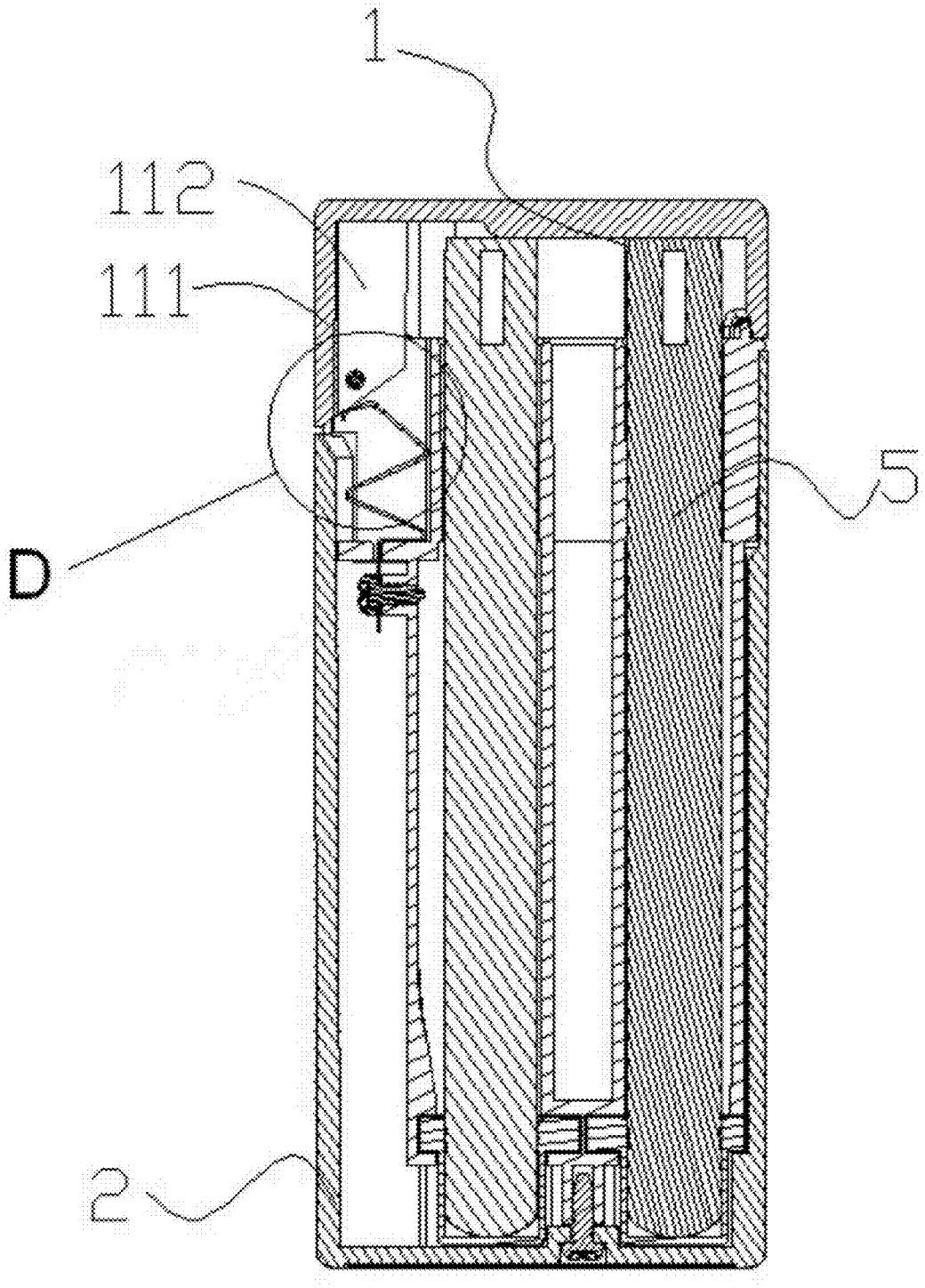
FIG. 9 is a cut-away view of the electronic cigarette case shown in FIG. 8, wherein the case cover is fully closed.
Figure 10:
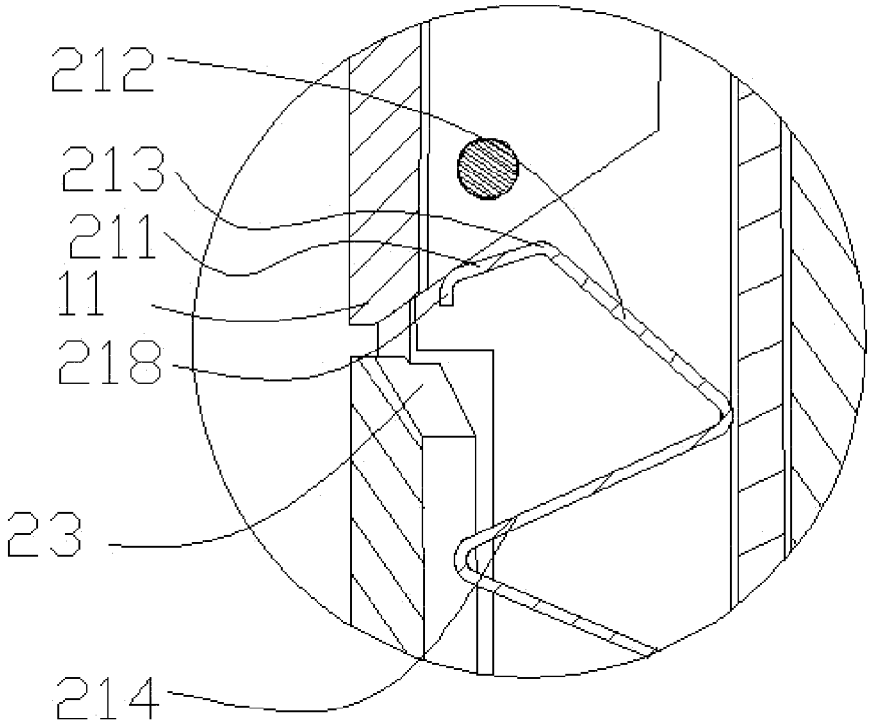
FIG. 10 is an enlarged view of the portion D shown in FIG. 9.
Figure 11:
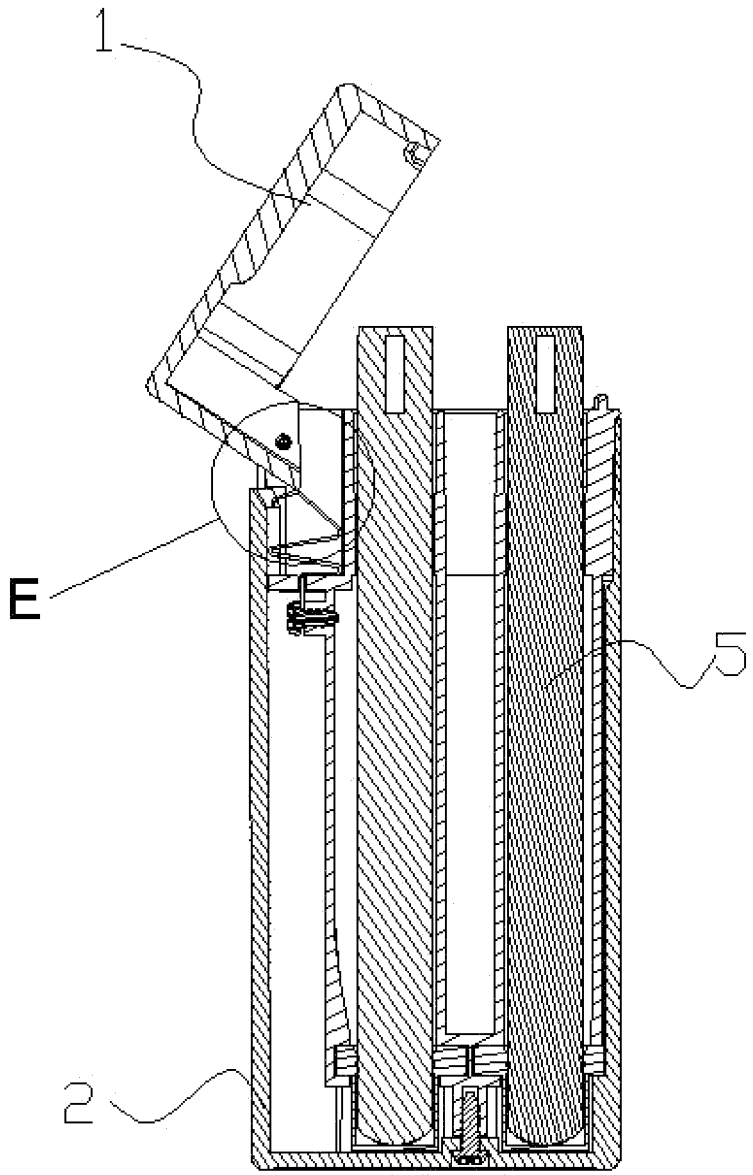
FIG. 11 is a cut-away view of the electronic cigarette case shown in FIG. 8, wherein the case cover is semi-open.
Figure 12:
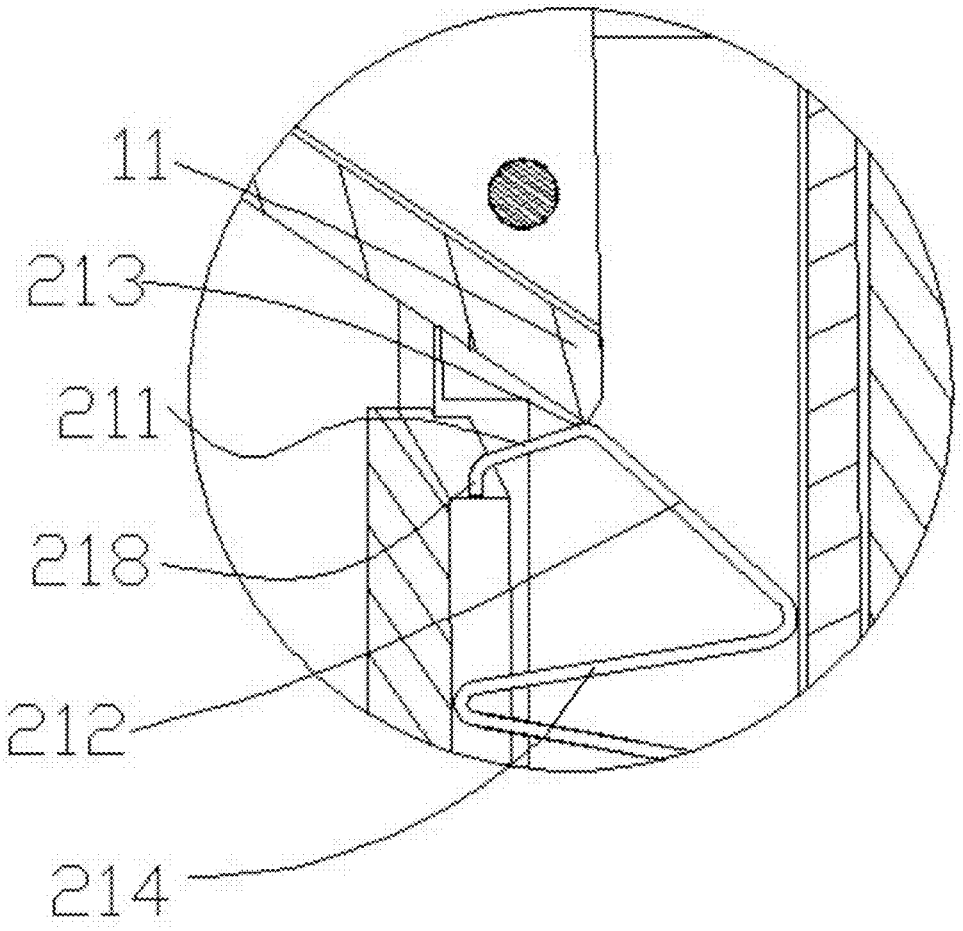
FIG. 12 is an enlarged view of the portion E shown in FIG. 11.
Figure 13:
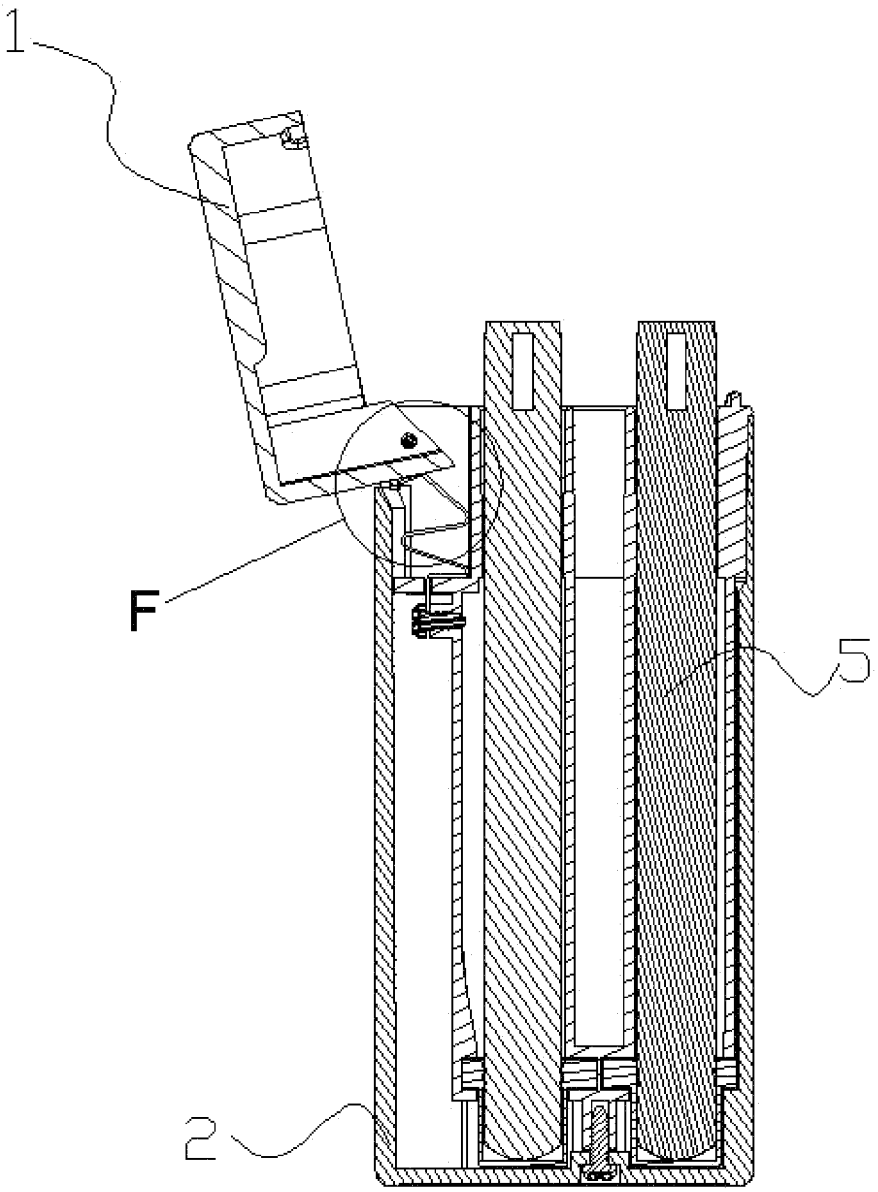
FIG. 13 is a cut-away view of the electronic cigarette case shown in FIG. 8, wherein the case cover is fully open.
Figure 14:
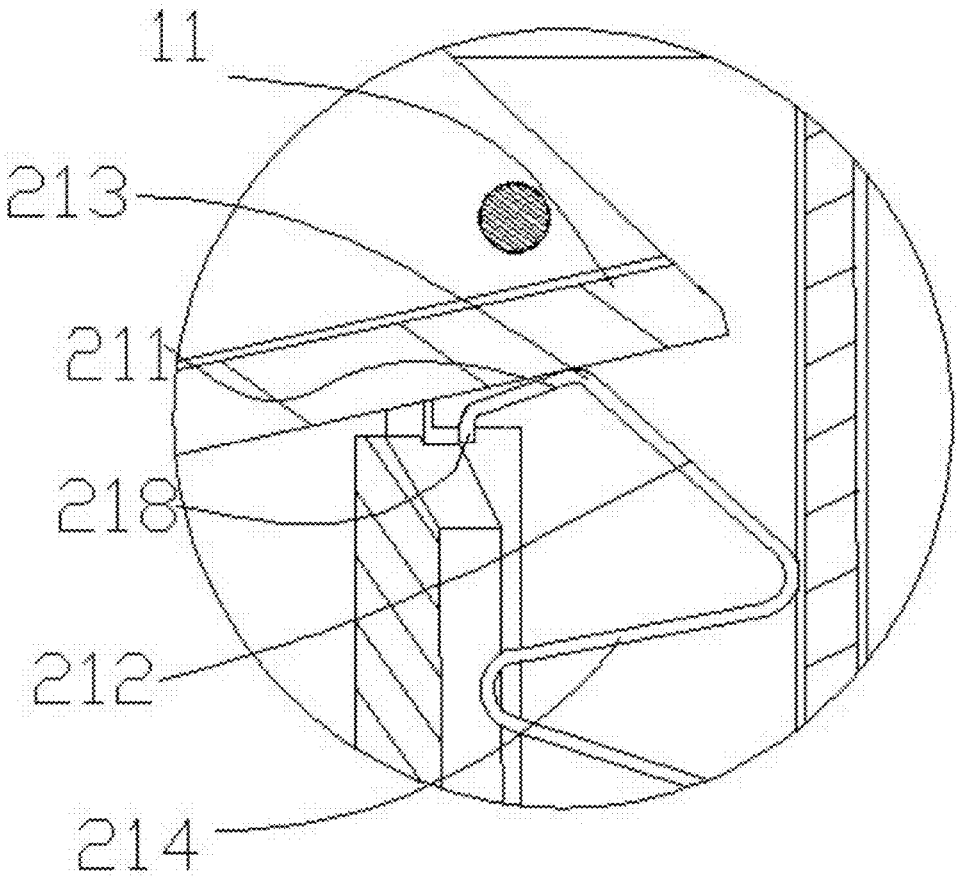
FIG. 14 is an enlarged view of the portion F shown in FIG. 13.
Figure 15:
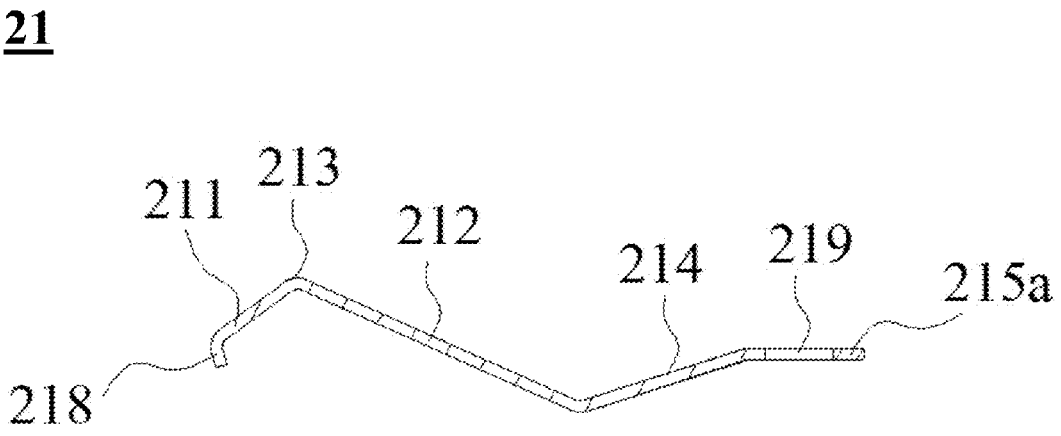
FIG. 15 is a cut-away view of an elastic member shown in FIG. 1.
Figure 16:
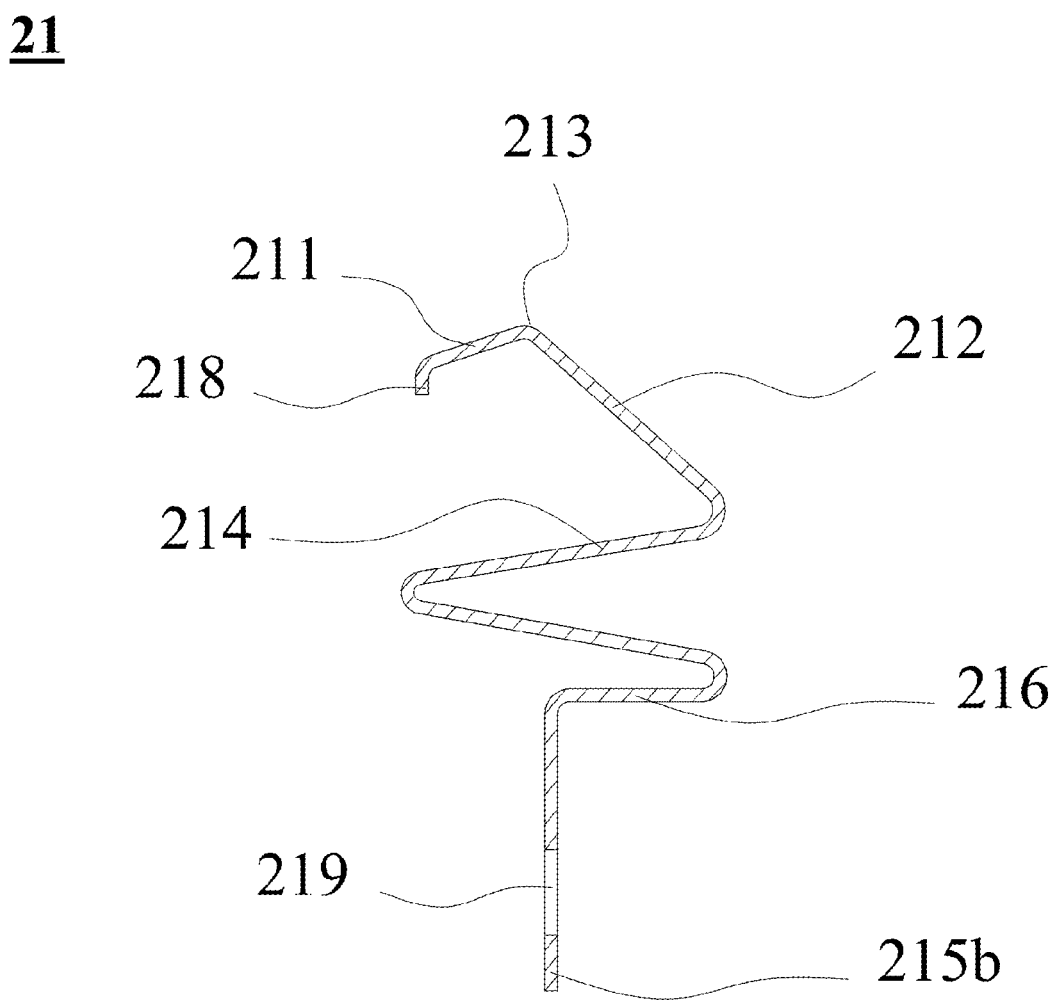
FIG. 16 is a cut-away view of an elastic member shown in FIG. 8.

As shown in FIGS. 1 to 16, the present application provides an electronic cigarette case, and the electronic cigarette case comprises a case body 2 and a case cover 1 hinged with the case body 2 by a hinging portion 3. An elastic member 21 is fixed in the case body 2. The elastic member 21 includes a first flange 213 protruding towards the case cover 1, and a first extension arm 211 slantly extending from a side of the first flange 213 and extending along a direction away from the case cover 1. A protruding portion 11 is formed on the case cover 1, and the protruding portion 11 slidably abuts against surfaces of the first extension arm 211 and the first flange 213 facing the case cover 1. When the case cover 1 is rotated along an open direction relative to the case body 2, the protruding portion 11 resists the first extension arm 211, and slides to the first flange 213 along the first extension arm 211. The first flange 213 drives the protruding portion 11 to continuously rotate along the rotating direction of the case cover 1 until the case cover 1 is fully open. Likewise, when the case cover 1 is rotated along the close direction relative to the case body 2, the protruding portion 11 slides to the first flange 213, and the first flange 213 and the first extension arm 211 successively respectively drive the protruding portion 11 to continuously rotate along the rotating direction of the case cover 1 until the case cover 1 is fully closed.

It can be understood that the first flange 213 is used as a critical point. In the opening process of the case cover 1, before the protruding portion 11 is rotated to the first flange 213, the elastic member 21 generates deformation under pressure. When the protruding portion 11 is rotated to the critical point, the deformation of the elastic member 21 begins to recover. When the protruding portion 11 is rotated beyond the critical point, the first flange 213 contacts one side surface of the protruding portion 11, and drives the protruding portion 11 to rotate along the open direction of the case cover 1 until the case cover 1 is fully open. In the closing process of the case cover 1, similarly, before the protruding portion 11 is rotated to the first flange 213, the elastic member 21 generates deformation under pressure. When the protruding portion 11 is rotated to the critical point, the first flange 213 and the first extension arm 211 successively respectively contact another side surface of the protruding portion 11, and drive the protruding portion 11 to rotate along the closed direction of the case cover 1 until the case cover 1 is fully closed. In this way, semi-automatically opening and closing processes of the case cover 1 can be achieved.

The elastic member 21 further includes a second extension arm 212. The first extension arm 211 and the second extension arm 212 are respectively located at two opposite sides of the first flange 213, and slantly extend along two opposite directions respectively. When the case cover 1 is closed, the protruding portion 11 slides to the first flange 213, and the first flange 213 drives the protruding portion 11 to continuously rotate along the rotating direction of the case cover 1 until the case cover 1 is fully closed. It can be understood that, in other embodiments, the protruding portion 11 can abut against the second extension arm 212, and can also not abut against the second extension arm 212, as long as the protruding portion 11 can slide to the first flange 213 in the closing process of the case cover 1.

In the present application, the first extension arm 211 and the second extension arm 212 are straight or arc-shaped. The first extension arm 211, the second extension arm 212 and the first flange 213 cooperatively form an inverted-V structure or an arc-shaped structure. Namely, the opening of the inverted-V structure or the arc-shaped structure faces a bottom of the case body 2.

The elastic member 21 is arranged inside the case body 2, and is located at a side of the case body 2 where the hinging portion 3 is located. A side of the case cover 1 where the hinging portion 3 is mounted extends along a direction away from a top of the case cover 1 to form the protruding portion 11. In the present application, the hinging portion 3 includes a vertical wall 112 extending inwards from a first side wall 111 of the case cover 1. Each of the vertical wall 112 and two second side walls of the case body 2 which are parallel with the vertical wall 112 defines an assembly through-hole configured to insert a rotation axle therein. When the rotation axle is inserted in the assembly through-holes of the vertical wall 112 and the case body 2, the hinging joint process is completed. Both the first side wall 111 and the vertical wall 112 extend along a direction away from a top of the case cover 1 to form the protruding portion 11. Two opposite side surfaces of the protruding portion 11 are respectively an outer surface of the first side wall 111 and a surface of the vertical wall 112 that is opposite to the outer surface of the first side wall 111.

A bending portion 218 is connected to an end of the first extension arm 211 that is away from the second extension arm 212. The bending portion 218 bends away from the case cover 1 and cooperates with the first extension arm 211 to form a second flange. A guiding surface 23 is formed on a portion of an inner surface of the case body 2 corresponding to the second flange, and the guiding surface 23 is configured to abut against the second flange and lead the second flange to slide along the guiding surface 23 when the case cover 1 is opened or closed. The guiding surface 23 is a slant surface or a curved surface.

Besides, as the second flange abuts against the guiding surface 23 and slides along the guiding surface 23 when the case cover 1 is opened or closed, the situation that a distal end of the first extension arm 211 is a free end and only generates a small deformation under pressure, which causes the automatically opening and closing processes of the case cover 1 to be difficult, can be avoided.

The elastic member 21 further includes a third extension arm 214. Two ends of the third extension arm 214 are respectively fixedly connected to the second extension arm 212 and the case body 2. The case body 2 accommodates a bracket 20, and the third extension arm 214 is connected to the case body 2 via the bracket 20.

The third extension arm 214 defines a first through-hole 219 configured to enable a screw 201 to pass through, and the bracket 20 defines a threaded hole 202. The screw 201 passes through the first through-hole 219 and is screwed in the threaded hole 202, so that the third extension arm 214 is fixed on the bracket 20. The method for fixing the elastic member 21 inside the case body 2 is not limited in the above-described one, and can also be other methods such as insertion.

The bracket 20 defines at least one accommodating portion 203 configured to accommodate an electronic cigarette 5. A fixing ring 204 is embedded in the accommodating portion 203, and the electronic cigarette 5 is inserted in the fixing ring 204 and form interference fit with the fixing ring 204.

The fixing ring 204 is made of soft material, such as silica gel, plastic cement, and resin, etc. Understandably, the method for fixing the electronic cigarette 5 can also be others, for example, a fixing block can be formed on an inner surface of the accommodating portion 203, and the electronic cigarette 5 abuts against a surface of the fixing block to form interference fit. Advantageously, the number of the fixing blocks is three, and three fixing blocks are disposed circumferentially and equidistantly. As well as the fixing ring 204, the fixing block is also made of soft material.

The third extension arm 214 is a line-folded structure or a line-curved structure extending along a direction away from the first extension arm 211. Understandably, at least one third flange disposed to be opposite to the first flange 213 is formed between the third extension arm 214 and the second extension arm 212. Because the first flange 213 is disposed opposite to the third flange, the elastic force is increased, and the automatically opening and closing processes of the case cover 1 can be completed more easily. It is understood that the extending direction of the third extension arm 214 is not limited. Advantageously, the third extension arm 214 can extend horizontally or vertically.

An electronic cigarette case of a first embodiment is as follows: as shown in FIGS. 1 to 7, the third extension arm 214 extends horizontally, and cooperates with the first extension arm 211 and the second extension arm 212 to form an elongated line-folded structure or an elongated line-curved structure. This structure is fit for the situation that less electronic cigarettes 5 need to be accommodated in the electronic cigarette case. In this embodiment, a first connecting portion 215*a* disposed horizontally extends from an end of the third extension arm 214. The first through-hole 219 configured to enable the screw 201 to pass through is defined in the first connecting portion 215*a*. A first lug boss 205*a* is formed on the bracket 20, and a surface of the first lug boss 205*a* corresponds to the first connecting portion 215*a*. The threaded hole 202 is defined in the first lug boss 205*a*. The first connecting portion 215*a* is arranged on the first lug boss 205*a*, and the screw 201 passes through the first through-hole 219 and is screwed in the threaded hole 202. Finally, the screw 201 is tightened up.

An electronic cigarette case of a second embodiment is as follows: as shown in FIGS. 8 to 14, the third extension arm 214 extends vertically, and cooperates with the second extension arm 212 to form an elongated line-folded structure or an elongated line-curved structure. As the third extension arm 214 extends vertically, the electronic cigarette case has enough accommodating space in the horizontal direction. This structure is fit for the situation that more electronic cigarettes 5 need to be accommodated in the electronic cigarette case, and has better fatigue resistance and a longer service life. In this embodiment, a second connecting portion 215*b* disposed vertically extends from an end of the third extension arm 214. The first through-hole 219 configured to enable the screw 201 to pass through is defined in the second connecting portion 215*b*. A second lug boss 205*b* is formed on the bracket 20, and a surface of the second lug boss 205*b* corresponds to the second connecting portion 215*b*. The threaded hole 202 is defined in the second lug boss 205*b*.

The second connecting portion 215*b* is arranged on the second lug boss 205*b*. The screw 201 passes through the first through-hole 219 and is screwed in the threaded hole 202. Finally, the screw 201 is tightened up.

Advantageously, in the second embodiment, the third extension arm 214 further includes an arm body 216 connected to the second connecting portion 215*b*, and the bracket 20 further includes a baffling portion 217 disposed between the arm body 216 and the second lug boss 205*b*. The second connecting portion 215*b* passes through the baffling portion 217, and an end of the arm body 216 that is adjacent to the second connecting portion 215*b* abuts against the baffling portion 217.

Generally, the elastic member 21 is mounted on the bracket 20 at first; and then the bracket 20 is mounted inside the case body 2. Herein, advantageously, mounting space facing a mounting direction of the screw 201 is formed, namely, the mounting space opens towards the mounting direction of the screw 201.

The electronic cigarette case further comprises a buckling portion configured to buckle the case cover 1 with the case body 2. Namely, the buckling portion includes a buckling position defined in the case cover 1 and a fastener formed on the case body 2 and corresponding to the buckling position, and the fastener is buckled in the buckling position.

In two above-described embodiments of the present application, the elastic member 21 can be a metal elastic plate, a metal wire, or a plastic elastic plate.

Above all, as the elastic member 21 including the first flange 213 and the first extension arm 211 is fixed inside the case body 2 of the electronic cigarette case, the protruding portion 11 is formed on the case cover 1, and the protruding portion 11 respectively slidably abuts against surfaces of the first flange 213 and the first extension arm 211 facing the case cover 1, the following operations can be achieved: when the case cover 1 is opened, the protruding portion 11 of the case cover 1 slides to the first flange 213, and the first flange 213 drives the case cover 1 to be fully opened. When the case cover 1 is closed, the protruding portion 11 also slides to the first flange 213; and the first flange 213 drives the case cover 1 to fully close. Thus, the semi-automatically opening and closing processes of the case cover 1 can be achieved. The structure of the electronic cigarette case is simple, and the case cover 1 can be opened or closed by a smaller external force. Thus, the opening and closing operations are easy, and the user's experience is improved.

While the embodiments of the present application are described with reference to the accompanying drawings above, the present application is not limited to the above-mentioned specific implementations. In fact, the above-mentioned specific implementations are intended to be exemplary not to be limiting. In the inspiration of the present application, those ordinary skills in the art can also make many modifications without breaking away from the subject of the present application and the protection scope of the claims. All these modifications belong to the protection of the present application.

What is claimed is:

1. An electronic cigarette case, comprising a case body, a case cover hinged with the case body via a hinging portion, and an elastic member fixed in the case body;

wherein, the elastic member includes a first flange protruding towards the case cover, a first extension arm slantly extending from a side of the first flange and extending along a direction away from the case cover, and a second extension arm; the first extension arm and the second extension arm are respectively located at two opposite sides of the first flange, and slantly extend along two opposite directions respectively;

a protruding portion is formed on the case cover, and the protruding portion slidably abuts against surfaces of the first extension arm and the first flange facing the case cover;

when the case cover is rotated along an open direction relative to the case body, the protruding portion resists the first extension arm and slides to the first flange along the first extension arm, and the first flange drives the protruding portion to continuously rotate along the rotating direction of the case cover until the case cover is fully open;

wherein, a bending portion is connected to an end of the first extension arm that is away from the second extension arm, and the bending portion bends away from the case cover and cooperates with the first extension arm to form a second flange.

2. The electronic cigarette case according to claim 1, wherein, a side of the case cover where the hinging portion is mounted extends along a direction away from a top of the case cover to form the protruding portion.

3. The electronic cigarette case according to claim 1, wherein, the first extension arm and the second extension arm are straight or arc-shaped; and the first extension arm, the second extension arm, and the first flange cooperatively form an inverted-V structure or an arc-shaped structure.

4. The electronic cigarette case according to claim 1, wherein, a portion of an inner surface of the case body corresponding to the second flange forms a guiding surface, the guiding surface is configured to abut against the second flange and lead the second flange to slide along the guiding surface when the case cover is opened or closed, and the guiding surface is a slant surface or a curved surface.

5. An electronic cigarette case, comprising a case body, a case cover hinged with the case body via a hinging portion, and an elastic member fixed in the case body;

wherein, the elastic member includes a first flange protruding towards the case cover, a first extension arm slantly extending from a side of the first flange and extending along a direction away from the case cover, and a second extension arm; the first extension arm and the second extension arm are respectively located at two opposite sides of the first flange, and slantly extend along two opposite directions respectively;

a protruding portion is formed on the case cover, and the protruding portion slidably abuts against surfaces of the first extension arm and the first flange facing the case cover;

when the case cover is rotated along an open direction relative to the case body, the protruding portion resists the first extension arm and slides to the first flange along the first extension arm, and the first flange drives the protruding portion to continuously rotate along the rotating direction of the case cover until the case cover is fully open;

wherein, the elastic member further includes a third extension arm, and two ends of the third extension arm are respectively fixedly connected to the second extension arm and the case body;

wherein, the case body accommodates a bracket, and the third extension arm is connected to the case body via the bracket.

6. The electronic cigarette case according to claim 5, wherein, the third extension arm defines a first through-hole configured to enable a screw to pass through, the bracket defines a threaded hole; the screw passes through the first through-hole, and is screwed in the threaded hole so that the third extension arm is fixed on the bracket.

7. The electronic cigarette case according to claim 5, wherein, the bracket defines at least one accommodating portion configured to accommodate an electronic cigarette; a fixing ring is embedded in the accommodating portion; and the electronic cigarette is inserted in the fixing ring by interference fit.

8. The electronic cigarette case according to claim 7, wherein, the fixing ring is made of soft material.

9. The electronic cigarette case according to claim 6, wherein, the third extension arm is a line-folded structure or a line-curved structure extending along a direction away from the first extension arm.

10. The electronic cigarette case according to claim 9, wherein, the third extension arm extends horizontally, and cooperates with the first extension arm and the second extension arm to form an elongated line-folded structure or an elongated line-curved structure.

11. The electronic cigarette case according to claim 10, wherein, a first connecting portion disposed horizontally is connected to an end of the third extension arm, and the first through-hole is defined in the first connecting portion; a first lug boss is formed on the bracket, and a surface of the first lug boss corresponds to the first connecting portion; and the threaded hole is defined in the first lug boss;

the first connecting portion is arranged on the first lug boss; and the screw passes through the first through-hole and is screwed in the threaded hole.

12. The electronic cigarette case according to claim 9, wherein, the third extension arm extends vertically, and cooperates with the second extension arm to form an elongated line-folded structure or an elongated line-curved structure.

13. The electronic cigarette case according to claim 12, wherein, a second connecting portion disposed vertically is connected to an end of the third extension arm, and the first through-hole is arranged in the second connecting portion; a second lug boss is formed on the bracket, and a surface of the second lug boss corresponds to the second connecting portion; and the threaded hole is defined in the second lug boss;

the second connecting portion is arranged on the second lug boss; and the screw passes through the first through-hole and is screwed in the threaded hole.

14. The electronic cigarette case according to claim 13, wherein, the third extension arm further includes an arm body connected to the second connecting portion;

the bracket further includes a baffling portion disposed between the arm body and the second lug boss; the second connecting portion passes through the baffling portion; and an end of the arm body that is adjacent to the second connecting portion abuts against the baffling portion.

15. The electronic cigarette case according to claim 1, wherein, the elastic member is a metal elastic plate, a metal wire, or a plastic elastic plate.

* * * * *